US007314419B2

(12) United States Patent
Grace et al.

(10) Patent No.: US 7,314,419 B2
(45) Date of Patent: Jan. 1, 2008

(54) ARCHERY SMALL GAME ARROWHEAD

(75) Inventors: Louis Grace, North Street, MI (US); Nathaniel E. Grace, Port Huron, MI (US)

(73) Assignee: G5 Outdoors, L.L.C., Memphis, MI (US)

( * ) Notice: Subject to any disclaimer, the term of this patent is extended or adjusted under 35 U.S.C. 154(b) by 0 days.

(21) Appl. No.: 11/461,229

(22) Filed: Jul. 31, 2006

(65) Prior Publication Data

US 2007/0026980 A1 Feb. 1, 2007

Related U.S. Application Data

(60) Provisional application No. 60/704,119, filed on Aug. 1, 2005.

(51) Int. Cl.
*F42B 6/08* (2006.01)

(52) U.S. Cl. ..... 473/583

(58) Field of Classification Search ..... 473/582, 473/583, 584

See application file for complete search history.

(56) References Cited

U.S. PATENT DOCUMENTS 2,350,581 A * 6/1944 Boose ..... 473/583
2,671,664 A * 3/1954 Zwickey ..... 473/582
3,064,977 A * 11/1962 Zwickey ..... 473/582
3,241,836 A * 3/1966 Zwickey ..... 473/582
4,471,962 A * 9/1984 Godfrey ..... 473/582
5,570,530 A * 11/1996 Lee ..... 43/1
6,290,903 B1 9/2001 Grace, Jr. et al.
6,595,881 B1 7/2003 Grace, Jr. et al.
6,749,801 B1 6/2004 Grace, Jr. et al.
6,817,269 B1 11/2004 Grace, Jr.
6,935,976 B1 8/2005 Grace, Jr. et al.
6,997,827 B1 2/2006 Grace, Jr. et al.
7,013,772 B1 3/2006 Grace, Jr. et al.

OTHER PUBLICATIONS

Gobbler—Guliatene (2004), 2 pp.
Barta Blunt (2004), 1 p.
Various Prior Art Blunt Archery Heads, 1 p.
Snaro Archery Point (prior art), 1 p.
Judo Point (prior art).

* cited by examiner

*Primary Examiner*—John A. Ricci
(74) *Attorney, Agent, or Firm*—Warner Norcross & Judd LLP

(57) ABSTRACT

An archery arrowhead including having a nose and at least one projection having a forward facing leading edge. In one embodiment, the arrowhead includes at least three projections, and the nose is blunt. The projections can be fixed and immovable relative to the arrowhead and the leading edges can be sharpened. The nose and the projections can form a unitary, monolithic body. Optionally, the leading edge can be curvilinear, linear or a combination curvilinear/linear. The edge can be sharpened to provide a cutting surface on the projection. The arrowhead can be manufactured using a variety of techniques including Powder Injection Molding (PIM), casting, molding, machining, and the like.

13 Claims, 5 Drawing Sheets

ARCHERY SMALL GAME ARROWHEAD

This application claims benefit of U.S. provisional patent application 60/704,119, filed Aug. 1, 2005.

BACKGROUND OF THE INVENTION

The present invention relates generally to archery arrowheads, and in particular, to small game archery arrowheads.

Small game arrowheads are similar to other arrowheads in that they are designed to be secured to the tip of an archery arrow. When the arrow is shot from an archery bow, the arrowheads are the first part of the arrow/arrowhead combination that impact a target or game. Small game arrowheads generally are designed to stun and preferably immediately harvest upon impact with the small game.

Currently, there are two primary designs for small game arrowheads. First, there is the blunt head, which is shown in FIG. 1. The blunt head 2 generally includes a cylindrical portion 4, made of metal or hard rubber, and a base 6 which threads into an arrow insert 8 held by an arrow 10. The blunt head may taper so that the impact end is slightly larger than the end near the arrow. Notably, the blunt head defines no discernable cutting surface. Therefore, to harvest small game, the blunt head's function is to impart a shocking effect upon impact to stun and harvest the game.

Sometimes, the blunt head may penetrate the game to an extent, which depends on the kinetic energy imparted by the arrow to the game to provide added cutting surfaces when the blunt head penetrates the game. Indeed, some manufacturers supply a separate add-on collar. As shown in FIG. 1, the collar 3 includes fixed rearward-only facing blades 5 and fits between the blunt head 4 and the arrow 10.

A second conventional small game arrowhead is exemplified by the Judo™ small game head, which is shown in FIG. 2. The Judo™ head includes a blunt tip 7 and a base 6 which threads into the arrow 10. Between the tip and the base, separate and independent spring arms 9 are secured. Like the blunt arrowhead above, the Judo™ head defines no discernable cutting surface. Accordingly, its primary function also is to stun and harvest the game. Upon missing the game with a shot arrow/arrowhead combination, the spring arms function to "grab" grass, weeds or dirt on the ground to slow the arrow as it travels through or over these objects, and preferably, to stand the arrow at an angle so that it is readily findable by the archer.

Although the above current small game arrowhead designs provide satisfactory game stunning capabilities, they suffer several shortcomings. First, both designs rely primarily on the kinetic energy generated upon impact of the arrowhead with the game to stun the game. Many times, however, the energy is insufficient to completely immobilize the game. This can be considered inhumane.

Second, both designs are prone to loss of the arrowhead and the respective arrow. For example, upon missing a target, the blunt head easily travels through environmental structure, e.g., grass, weeds, etc., thereby becoming difficult to find. This design also can carom off hard objects, such as rocks or trees with the same result. Further, although the Judo™ head includes spring arms that grab environmental structures and make the arrow stand, after several shots from a conventional high arrow speed bow, these arms usually bend or break. Accordingly, the Judo™ head can become as difficult to find as the blunt head after several uses in the field due to failed spring arms.

SUMMARY OF THE INVENTION

The aforementioned problems are overcome by an archery arrowhead including a body having a nose and at least one projection having a forward facing edge.

In one embodiment, the arrowhead can include multiple forward facing projections, each including a leading edge which is sharpened. Where there are at least three projections, those projections can collectively mimic an avian talon.

In another embodiment, the projections can be fixed and immovable relative to the arrowhead. In this embodiment, the blunt nose and the projections can form a unitary, monolithic body. Optionally, the body can include a base, which is either threaded to secure the arrowhead to a conventional aluminum, carbon or composite arrow, or defines a recess to secure the arrowhead to a traditional wooden arrow.

In a further embodiment, the leading edge of the projection can include differently oriented portions. Optionally, a first portion of the edge can project rearward, toward an arrow to which the arrowhead is secured; a second portion of the edge can project generally perpendicular to the body; and a third portion can project forward, away from arrow. Further optionally, any of these portions can be sharpened.

In a yet further embodiment, the leading edge can be curvilinear, linear or a combination curvilinear/linear edge. Further, the first, second and third edge portions of the leading edge, of either configuration, can be contiguous along the edge and can transition smoothly and cleanly from one to another as desired.

In another further embodiment, the leading edge is concave or at least angled to ease sharpening of the leading edge with an appropriate file to create a sharpened edge.

The present archery arrowhead is robust, flies with great stability, and quickly immobilizes game impacted by the arrowhead. Specifically, the blunt nose provides a stunning impact on game. The projection further grabs and tears tissue near the impact point of the nose. Where included, the leading edge and/or sharpened edge increase the penetration of the arrowhead by providing further cutting at the impact site. In addition, the projection operates to flip the arrowhead and an associated arrow upward upon impact with environmental structure to provide easy recovery of the arrowhead/arrow by an archer. Also, with the configuration of the projections, the sharpened edge can be easily sharpened in the field with a simple tool, such as a file, to ensure consistent and humane harvesting of game. Further, due to the optional monolithic construction, the arrowhead is able to withstand encounters with hard objects, such as rocks, trees, etc., without sustaining significant damage. This ensures that individual arrowheads are durable and can be re-used multiple times.

These and other objects, advantages, and features of the invention will be more fully understood and appreciated by reference to the description of the current embodiments and the drawings.

DETAILED DESCRIPTION OF THE CURRENT EMBODIMENT

I. Construction

Figure 1:
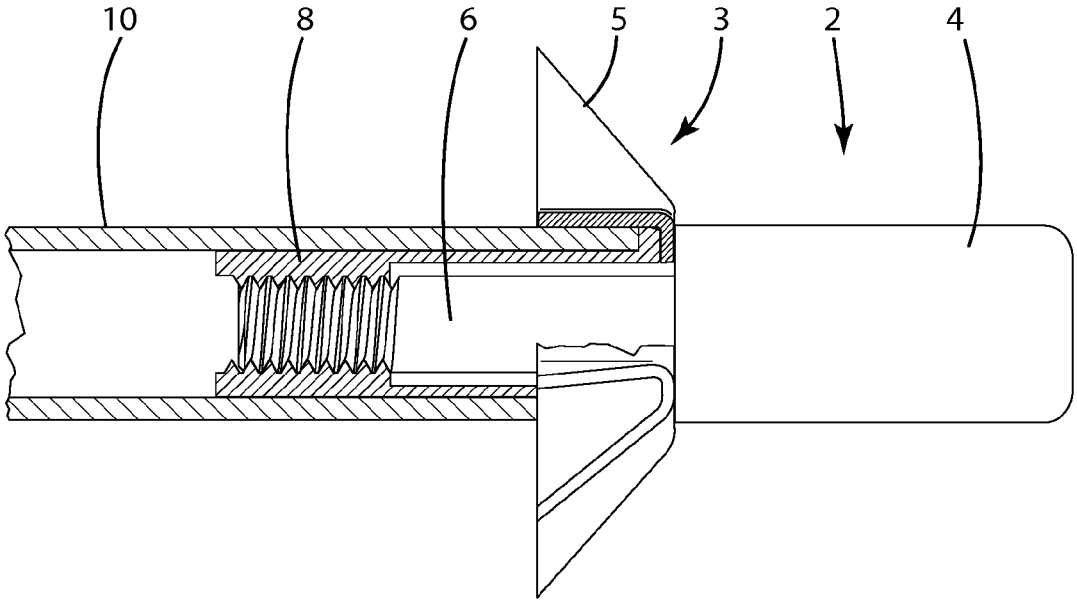
Fig. 1 (Prior Art)
FIG. 1 is a side view of a prior art blunt arrowhead secured to an arrow.
Figure 2:
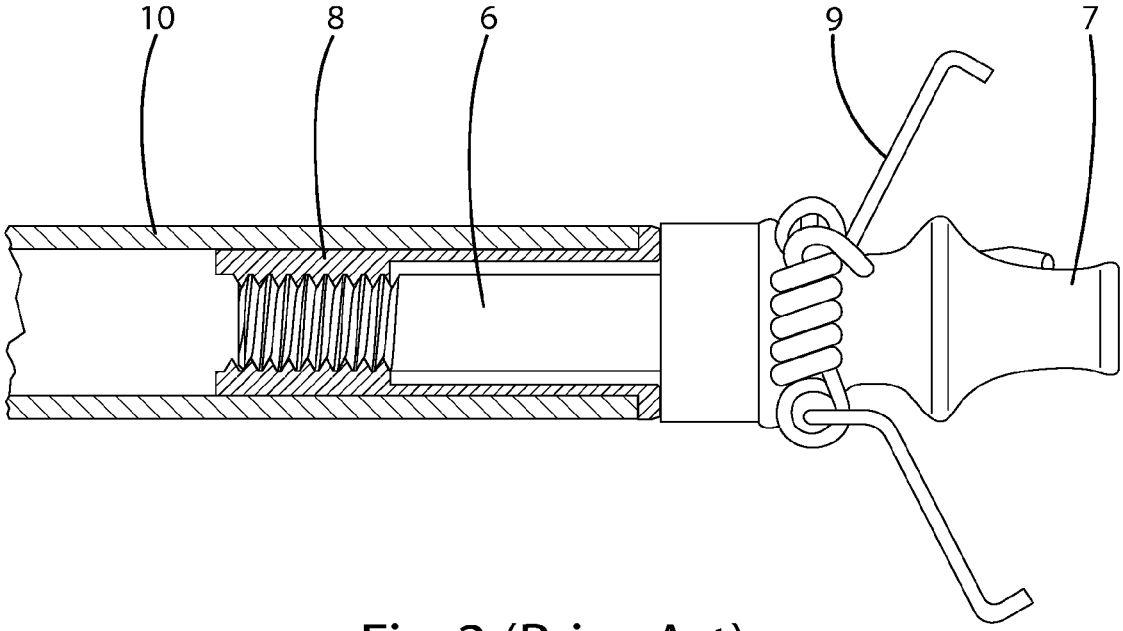
Fig. 2 (Prior Art)
FIG. 2 is a side view of a prior art Judo arrowhead secured to an arrow.

An archery arrowhead constructed in accordance with a current embodiment of the invention is illustrated in FIGS. 3-8 and generally designated 20. The arrowhead 20 generally includes a body 30, a nose 40, forward projecting projections 50, and a base 60. For purposes of this disclosure, the archery arrowhead is described in connection with its use with an archery arrow, however, the arrowhead is well suited for use with other projectiles. Further, as described here, the components of the arrowhead are formed as a single, integral, one piece, monolithic unit; however, as the application requires, one or more components may be separately constructed, and semi-permanently joined with the remaining components.

With reference to FIGS. 3-8, the components of the arrowhead will now be described. Projecting rearward from the body 30 is the base 60. The base 60 can include threads 62 which are configured to easily thread into any standard arrow insert for securing the arrowhead to an arrow. The base can further include a rim 63 which snugly seats against an arrow insert to secure the arrowhead to that insert and the respective arrow 10.

Projecting forward of the body is a nose 40. As shown, this nose generally projects along at least a portion of the longitudinal axis 100 of the arrowhead, and is blunt at its forwardmost, terminating end 42. The nose can be symmetric or asymmetric, or of any cross section, for example circular, elliptical, triangular, rectangular and the like, depending on the application. Optionally, if desired, the terminating end 42 of the nose can be tapered so that the cross section of the nose increases toward the terminating end. Further optionally, the terminating end 42 of the nose can include a sharpened point or a cutting edge (not shown).

Figure 4:
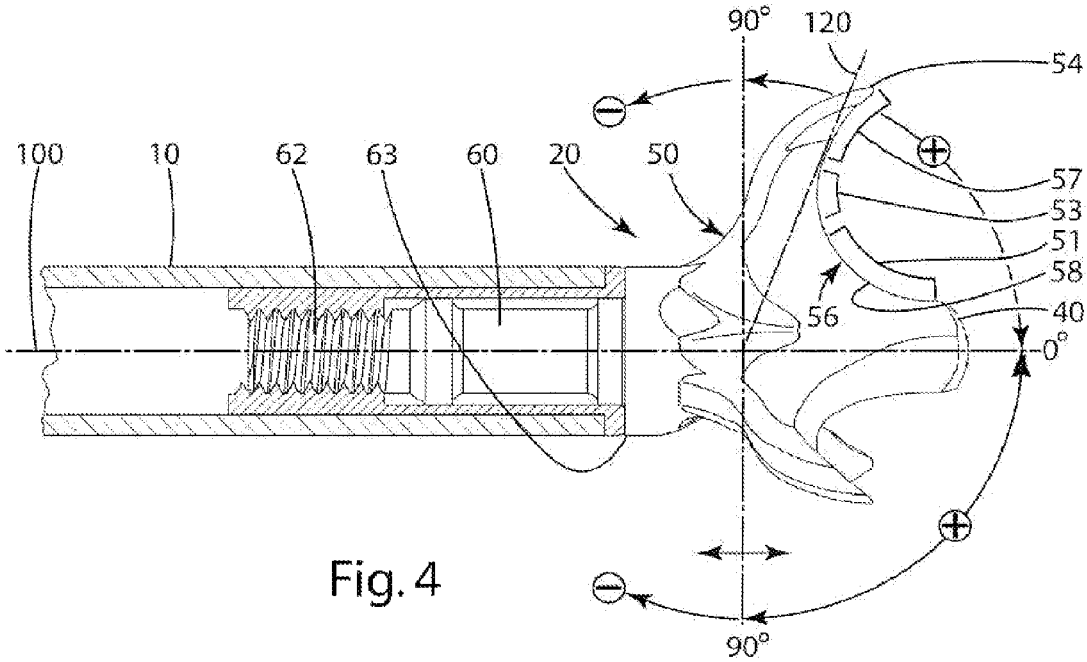
FIG. 4 is a side view of the arrowhead.
Figure 5:
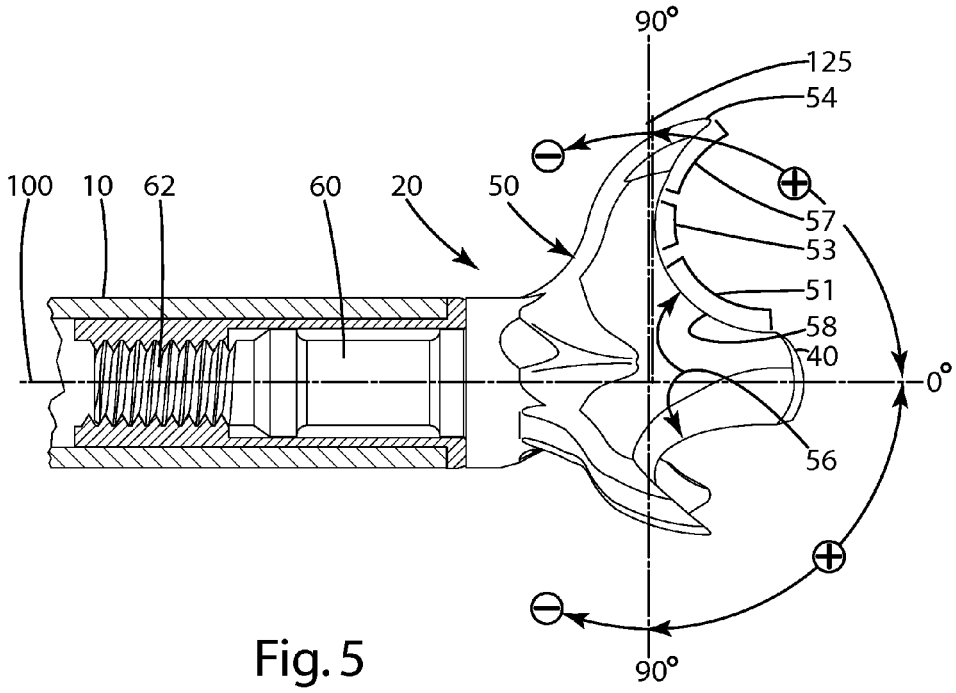
FIG. 5 is a second side view of the arrowhead.

With reference to FIGS. 4 and 5, the body 20 also includes one or more projections (also referred to as prongs) 50. As shown, there are three nearly identical projections extending radially from the longitudinal axis 100 of the arrowhead 20. Although positioned about 120 degrees from one another, the projections may vary in positioning number. For example, where two projections are included, they can be positioned 180 degrees from one another, where four projections are included, they can be positioned 90 degrees from one another, and so on. Also, where a projection 50 is part of a monolithic unit including the body 20 and the nose 40, that projection can be permanently immovable relative to these other components.

The projections 50 are generally forward projecting, and terminate at an end 54, which can be in the form of a point, an edge or any other structure as desired. The projections can include a leading edge 56 which optionally can extend from the nose 40 to the end 54, or whatever structure terminates the projection. The leading edge can be sharpened as desired to create a sharpened edge 58. As shown, this edge 58 is on one side of the leading edge 56 and a corner 59 is opposite the sharpened edge 58. The sharpened edge 58 can optionally extend from the nose 40 to the end 54, or whatever structure terminates the projection. The corner 59 can terminate at a location inward from the end 54 a pre-selected distance. The corner also need not be pronounced. For example, it can be the intersection of two or more planes, curved surfaces or combinations of the same.

Figure 3:
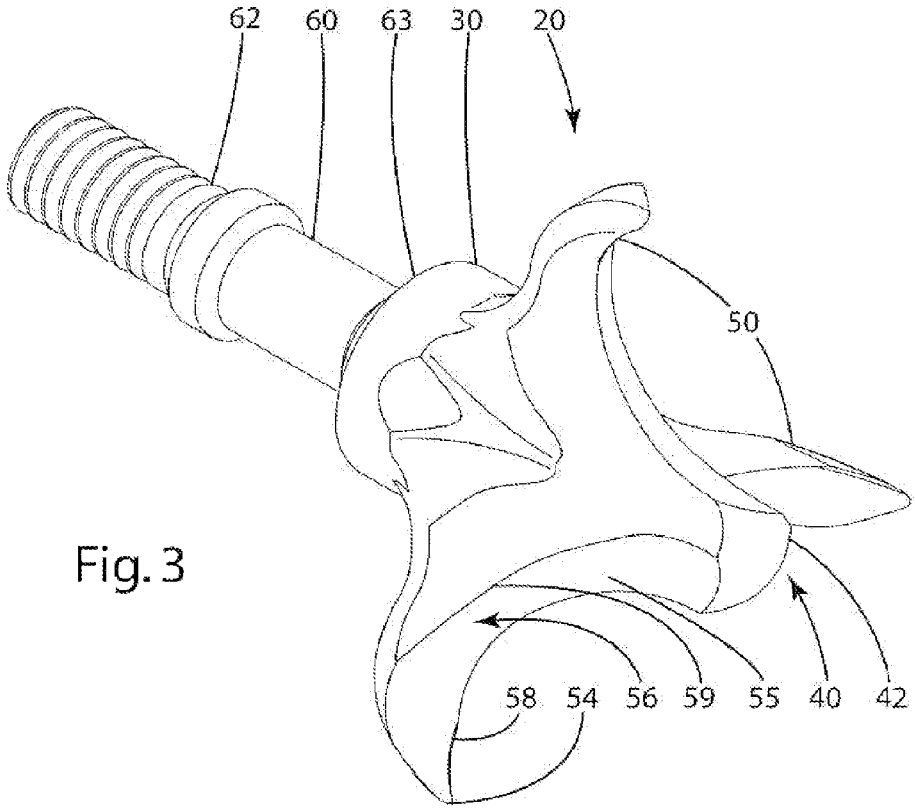
FIG. 3 is a front, perspective view of an embodiment of the arrowhead of the present invention secured to an arrow.

The area 55 between the sharpened edge 58 and the corner 59 can form a plane or surface of any desired configuration. As shown in FIG. 3, that area 55 is a continuous concave area. Optionally, the area can be divided into multiple, individual but contiguous planar, concave, or convex areas, which collectively transition from the nose to the end or terminus 54 of the projection. Further optionally, the area between the sharpened edge and the corner can also include the relatively planar surface between a cutting edge on a steel blade and the end of that sharpened edge, for example, where a sharpening grind mark ends on the blade.

With regard the orientation of components and portions of components, these items are sometimes described herein as being at a "positive angle" or a "negative angle." With reference to FIG. 4, as used herein, a component or component portion is at a "positive angle" when it is possible to project a line 120 parallel to or tangential to the forward most part of the component or component portion so that the line 120 intersects the longitudinal axis 100, and the line 120 is at an angle relative to the longitudinal axis that is in the range of about 0 degrees to (and including) about 90 degrees. FIG. 5 illustrates another exemplary component or component portion at a positive angle, as measured by line 125, which is at 90 degrees to the longitudinal axis 100. As used herein, a "forward facing" component or portion of a component is one that is disposed at a "positive angle".

Figure 6:
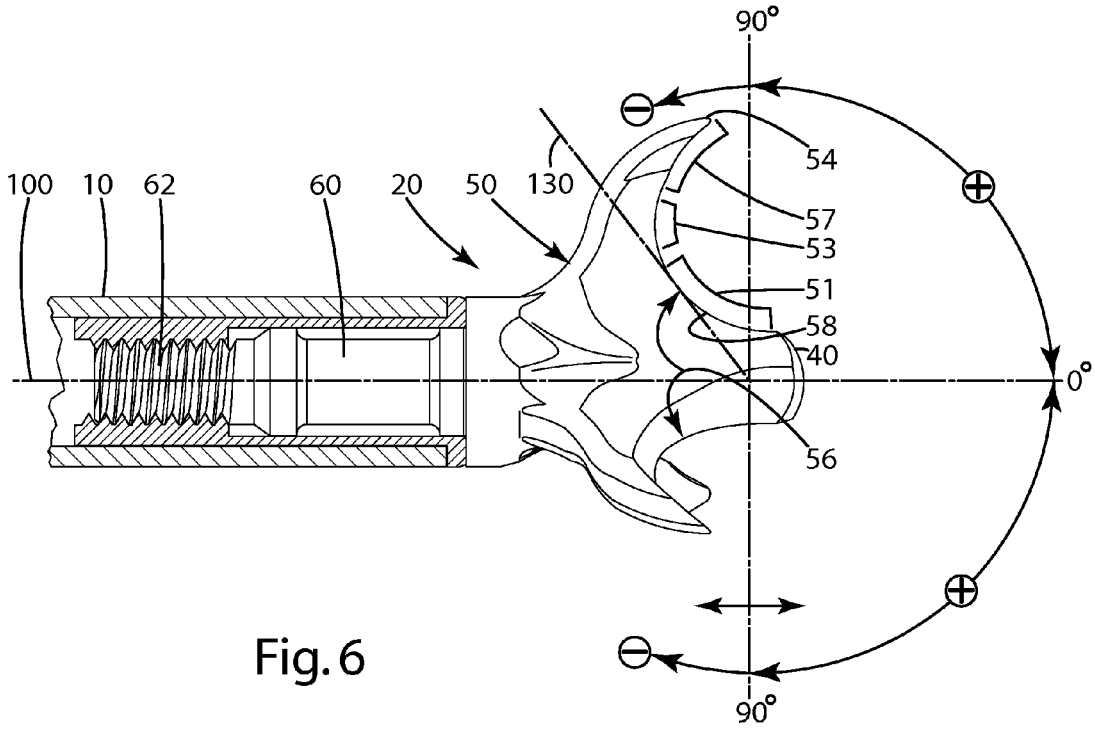
FIG. 6 is a third side view of the arrowhead.
Figure 7:
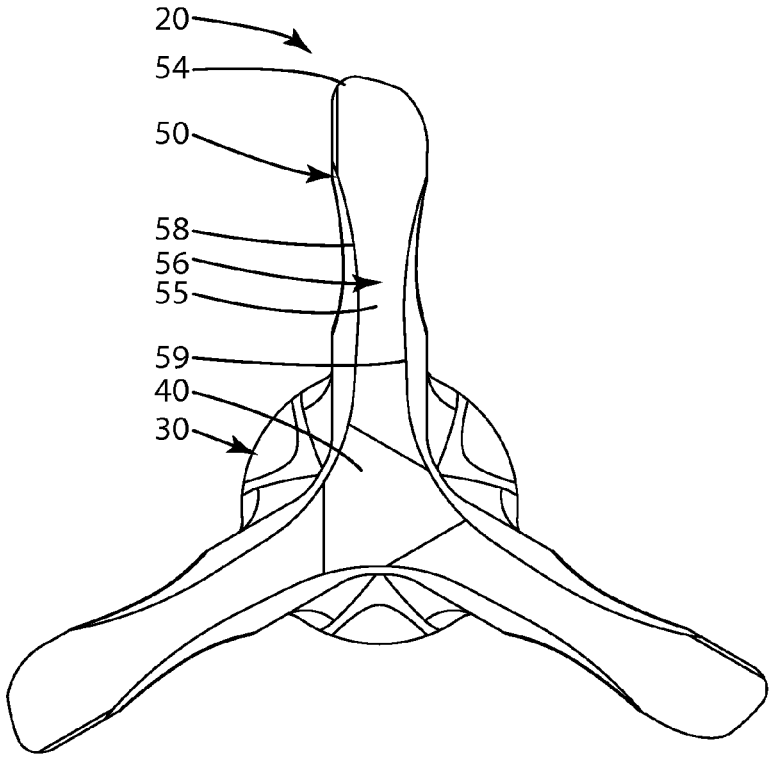
FIG. 7 is a front view of the arrowhead.
Figure 8:
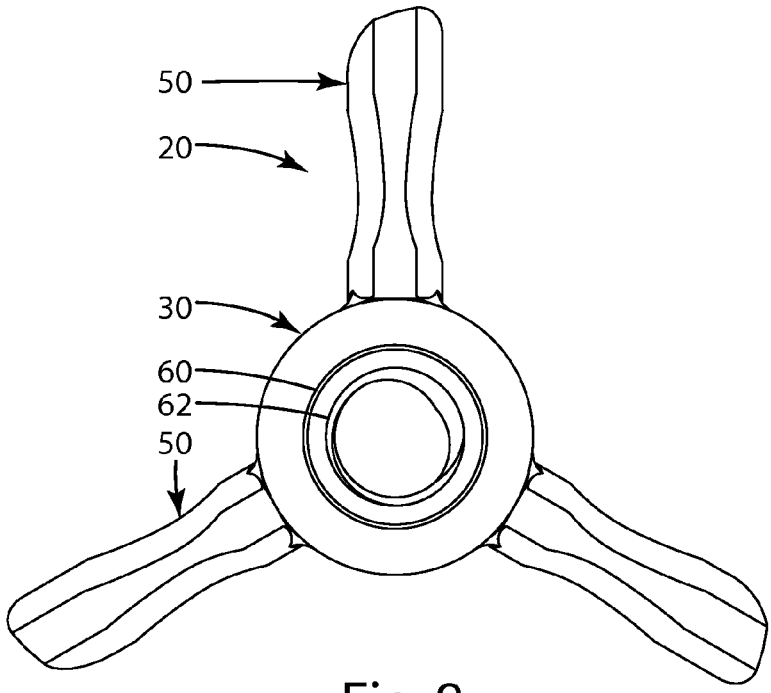
FIG. 8 is a rear view of the arrowhead.

With reference to FIG. 6, as used herein, a component or portion of a component is at a "negative angle" when it is possible to project a line 130 parallel to or tangential to forward most part of the component or component portion so that the line 130 intersects the longitudinal axis 100, and the line 130 is at an angle relative to the longitudinal axis of greater than 90 degrees. In addition, as used herein, any component or component portion that is "rearward facing" is disposed at a "negative angle."

Referring further to FIGS. 4-6, the leading edge 56 and/or sharpened edge 58 can be divided into different portions, for example, a first edge portion 51, a second edge portion 53 and a third edge portion 57. Collectively, these portions transition from the nose 40 to the end 54 of the projection 50, optionally forming a continuous curvilinear edge transitioning from the nose to the end.

The edge portions can be configured so that the first edge portion 51 is generally disposed at a negative angle (FIG. 6), the second edge portion 53 is generally disposed at a positive angle (FIG. 5), and the third edge portion 57 is generally disposed at a positive angle (FIG. 4). With this or similar configurations, a projection 50 can be said to include a forward facing portion.

Figure 9:
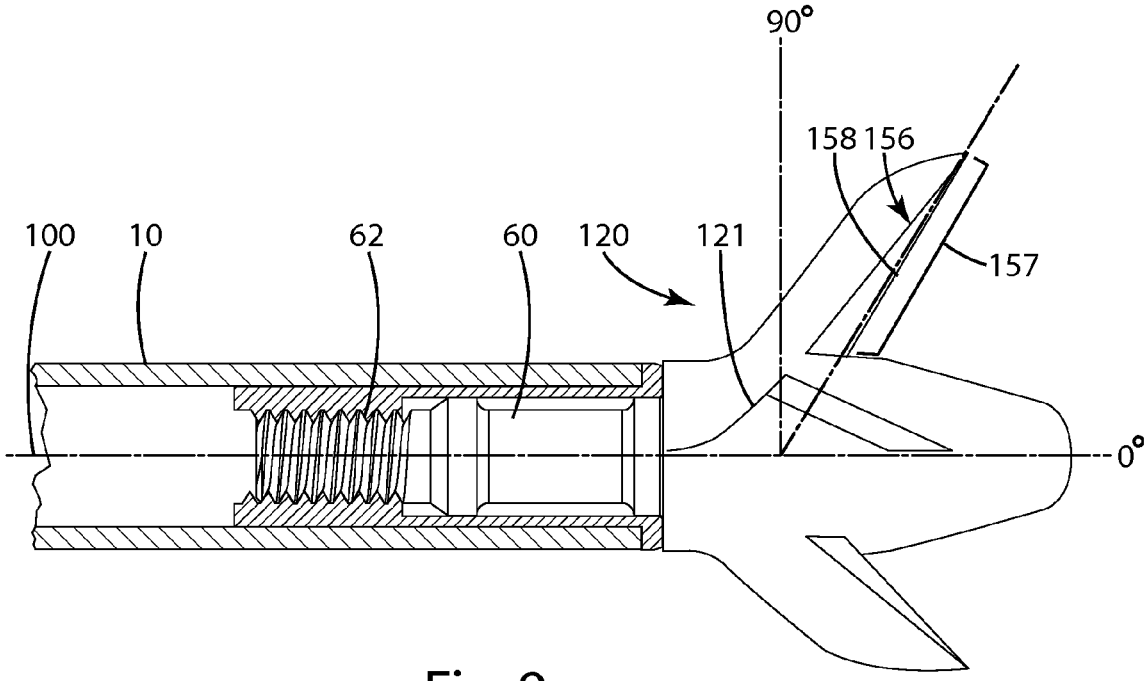
FIG. 9 is a side view of an alternative embodiment of the arrowhead.

Optionally, the edge portions 51, 53 and 57 can be disposed at different angles and the edge portions can be added or subtracted. For example, FIG. 9 shows an alternative embodiment including all the features of the embodiment described above; however, the leading edge 156 and/or sharpened edge 158 of the arrowhead 120 includes a substantially linear edge portion 157 disposed at a positive angle. Further optionally, between adjacent projections, additional blades or smaller projections or barbs 121 can be added to enhance the immobilization ability of the arrowhead 120.

The arrowhead 20 and any of its components can be manufactured from a variety of materials, including, for example, steel, stainless steel, magnesium, magnesium alloy, aluminum, aluminum alloy, titanium, titanium alloy, zinc, zinc alloy, other suitable metals, plastics, ceramics and any combination of the foregoing. In addition, the arrowhead and its components can be manufactured using any one or more of a variety of techniques, such as: Powder Injection Molding (PIM), for example, Metal Injection Molding (MIM) or Ceramic Injection Molding (CIM); die casting; investment casting; thixotropic molding; injection molding; machining such as screw machining; or any other suitable manufacturing technique.

II. Operation and Use of the Arrowhead

Operation and use of the arrowhead 20 will now be described in connection with FIG. 3. In general, the threaded base 60 is threaded into the arrow insert to secure the arrowhead to the arrow 10. The base rim 63 snugly seats against the arrow insert to secure the arrowhead to that insert and thus the arrow 10. With the arrowhead 20 firmly secured to the arrow, it is ready for shooting from an archery bow (now shown) in a conventional manner.

Due to its aerodynamic properties, the arrowhead 20 flies with great stability along a trajectory very similar to standard field points. What this means is that it is easy for archers to quickly change from their practice field points to the small game arrowhead described herein without having to recalibrate the sights on their archery bow.

In addition, the configuration of the arrowhead lends itself well to quick and rapid immobilization of game. Specifically, the nose 40 imparts a stunning force when it impacts game. The projections 50 add tissue and organ tearing capability. Where sharpened, the edges 58 can further enhance cutting to improve hemorrhaging of the impacted game to ensure a quick harvest. It is noted that in the embodiment shown, when the arrowhead impacts game or a target, the contact sequence with a straight-on shot would be such that the nose 40 impacts the game to initiate a stunning force first. Shortly thereafter, almost substantially simultaneously, the ends of the projections 50 would impact, and the ends 54 and/or sharpened edges 58 would begin to penetrate and/or cut the impacted part of the game.

Further, upon a miss of game or an intended target, the arrowhead 20 readily grabs environmental structure, for example, grass, weeds, branches, foliage, the ground or other objects on the ground to flip the attached arrow 10 into the air and make it easier to locate. It is believed that the forward facing portion of the projections 60 act as a shovel to assist or promote this flipping action when the arrowhead impacts.

Finally, the arrowhead 20 is very easy to sharpen in the field. An archer can file the sharpened edge 58 with a rat-file or flat file to render the edge very sharp. This can be done by simply moving the file over the area 55 on the leading edge, allowing the file to sharpen the edge. This can increase the effective usable life of the small game arrowhead.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The embodiments of the invention in which an exclusive property or privilege is claimed are defined as follows:

1. An archery arrowhead comprising:

a base including threads adapted to thread into an arrow insert;

a body joined with the base;

a blunt nose extending forwardly from the body;

a plurality of projections extending fixedly from the body, each projection including a leading edge, the leading edge including a corner and a sharpened edge with an area defined therebetween, at least one portion of the sharpened edge being disposed at a positive angle, whereby the blunt nose provides an impact surface to stun game impacted by the arrowhead, and whereby the sharpened edge provides a cutting surface to substantially simultaneously penetrate the game impacted by the arrowhead.

2. The archery arrowhead of claim 1 wherein the body, blunt nose and plurality of projections form an integral, monolithic unit.

3. The archery arrowhead of claim 1 wherein at least two projections extend from the body.

4. The archery arrowhead of claim 1 wherein the sharpened edge is curvilinear.

5. The archery arrowhead of claim 1 wherein the sharpened edge includes a first portion at a first positive angle, a second portion at a second positive angle, and a third portion at a negative angle.

6. The archery arrowhead of claim 5 wherein the first portion, second portion and third portion are contiguous.

7. The archery arrowhead of claim 6 wherein the first portion, second portion and third portion collectively form a curvilinear edge.

8. An archery arrowhead comprising:

a base;

a body joined with the base;

a nose projecting from the body;

a forward projecting projection extending from the body, the projection including at least one forward facing edge, whereby the nose transfers a stunning force to game impacted by the arrowhead, and whereby the edge of the projection assists in penetrating the game impacted by the arrowhead;

wherein the projection is disposed in a fixed, immovable position relative to the body.

9. An archery arrowhead comprising:

a base;

a body joined with the base;

a nose projecting from the body;

a forward projecting projection extending from the body, the projection including at least one forward facing edge, whereby the nose transfers a stunning force to game impacted by the arrowhead, and whereby the edge of the projection assists in penetrating the game impacted by the arrowhead;

wherein the edge is substantially linear.

10. An archery arrowhead comprising:

a base;

a body joined with the base;

a nose projecting from the body;

a forward projecting projection extending from the body, the projection including at least one forward facing edge, whereby the nose transfers a stunning force to game impacted by the arrowhead, and whereby the edge of the projection assists in penetrating the game impacted by the arrowhead;

wherein the edge includes a plurality of portions, at least one of the portions disposed at a positive angle and at least a different one of the portions disposed at a negative angle.

11. An archery arrowhead comprising:

a base;

a body joined with the base;

a nose projecting from the body;

a forward projecting projection extending from the body, the projection including at least one forward facing edge, whereby the nose transfers a stunning force to game impacted by the arrowhead, and whereby the edge of the projection assists in penetrating the game impacted by the arrowhead;

wherein the base, the nose, the body and the projection form a one piece, monolithic unit.

12. An archery arrowhead comprising: a body including a blunt nose, a longitudinal axis, and a projection, the projection being fixed and immovable relative to the body and having at least a portion of a forward curving edge, the projection extending outwardly, away from the longitudinal axis.

13. An archery arrowhead comprising: a body including a blunt nose and a projection, the projection being fixed relative to the body and having at least a portion of an edge disposed at a positive angle wherein the body, nose and projection form a one piece, monolithic unit.

* * * * *